US010211526B2

(12) United States Patent
Schmid

(10) Patent No.: US 10,211,526 B2
(45) Date of Patent: Feb. 19, 2019

(54) PCB BEAM-FORMING ANTENNA

(71) Applicant: Texas Instruments Incorporated, Dallas, TX (US)

(72) Inventor: Rea Richard Schmid, Rochester, MN (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 157 days.

(21) Appl. No.: 14/496,919

(22) Filed: Sep. 25, 2014

(65) Prior Publication Data

US 2016/0093951 A1 Mar. 31, 2016

(51) Int. Cl.
*H01Q 3/24* (2006.01)
*H01Q 1/48* (2006.01)
*H01Q 19/32* (2006.01)

(52) U.S. Cl.
CPC ..... *H01Q 3/24* (2013.01); *H01Q 1/48* (2013.01); *H01Q 19/32* (2013.01)

(58) Field of Classification Search
CPC ..... H01Q 1/48; H01Q 3/24
USPC ..... 343/724, 876, 893, 700 MS
See application file for complete search history.

(56) References Cited

U.S. PATENT DOCUMENTS 6,933,900 B2 * 8/2005 Kitamori ..... H01Q 1/3233 343/713
2004/0164905 A1 * 8/2004 Tran ..... H01Q 1/38 343/700 MS
2005/0110683 A1 * 5/2005 Song ..... H01Q 1/246 343/700 MS
2005/0237258 A1 * 10/2005 Abramov ..... H01Q 3/24 343/834
2007/0195004 A1 * 8/2007 Rebeiz ..... H01Q 1/3233 343/876
2010/0013730 A1 * 1/2010 Azhari ..... H01Q 1/243 343/848
2010/0033397 A1 * 2/2010 Narasimhan ..... H01Q 1/38 343/860
2010/0195753 A1 * 8/2010 Yamamoto ..... H01Q 1/243 375/267
2010/0328163 A1 * 12/2010 Abramov ..... H01Q 1/521 343/702

* cited by examiner

*Primary Examiner* — Jessica Han
*Assistant Examiner* — Jae Kim
(74) *Attorney, Agent, or Firm* — Michael A. Davis, Jr.; Charles A. Brill; Frank D. Cimino

(57) ABSTRACT

A two-dimensional antenna includes a ground plane, a primary radiator element, and at least one switchable radiator element. The ground plane comprises an electrically conductive material and is electrically coupled to an electrical ground. The primary radiator element is disposed in a coplanar relationship to said ground plane and is electrically coupled to a signal path of a transceiver. The at least one switchable radiator element is disposed in a coplanar relationship to the ground plane and the primary radiator element and is selectably electrically couplable to one of the signal path of the transceiver and the electrical ground.

8 Claims, 3 Drawing Sheets

PCB BEAM-FORMING ANTENNA

BACKGROUND

In modern communication devices, two-dimensional printed circuit board antennae allow an antenna to be implemented by printing an electrically conductive material on a standard printed circuit board (PCB). Such printed circuit board antennae are very cost-effective and minimize the amount of space needed to implement the antenna of the communication device.

FIG. 1 is a schematic diagram depicting a conventional three-dimensional antenna 100 translated to the plane of the printed circuit board 110. The dipole radiator element 120 projects orthogonal to the ground plane 140 of the printed circuit board 110. The ground plane 110 replaces the return dipole 130 in the first projection.

The antenna is reduced to two dimensions by rotating the dipole radiator element 120 down to the plane of the printed circuit board 110, as shown in the FIG. 2, which is a top view of a printed circuit board 210. The dipole radiator element 220 is implemented on the circuit board 210 using an electrically conductive material such as copper. The radiator 220 is disposed adjacent to, but not on or over, the ground plane 230. In the embodiment of FIG. 2, the radiator 220 is a linear element and extends orthogonally from the ground plane 230.

The printed circuit board antenna of FIG. 2 generates a largely omnidirectional radiation pattern, i.e., the strength of the signal is approximately equal in all directions. In some applications it is desirable to generate a focused radiation beam and to be able to have control over the direction and strength of the generated beam.

SUMMARY

A two-dimensional printed circuit board antenna in accordance with an illustrative embodiment of the present invention includes a ground plane, a primary radiator element, and associated switchable ground radiator elements. The ground plane comprises an electrically conductive material and is electrically coupled to an electrical ground. The primary radiator element is disposed in a coplanar relationship to said ground plane and is electrically coupled to a signal path of a transceiver. The at least one switchable radiator element is disposed in a coplanar relationship to the ground plane and the primary radiator element and is selectably electrically couplable to one of the signal path of the transceiver and the electrical ground.

Another embodiment of the invention is directed to an electronic assembly comprising a printed circuit board and a two dimensional antenna. The two-dimensional antenna includes a ground plane, a primary radiator element, and at least one switchable radiator element. The ground plane is disposed on the printed circuit board and comprises an electrically conductive material and is electrically coupled to an electrical ground. The primary radiator element is disposed on the printed circuit board in a coplanar relationship to the ground plane and is electrically coupled to a signal path of a transceiver. The at least one switchable radiator element is disposed on the printed circuit board in a coplanar relationship to the ground plane and the primary radiator element and is selectably electrically couplable to one of the signal path of the transceiver and the electrical ground.

Another embodiment of the invention is directed to a method of operating a two-dimensional antenna. Pursuant to said method, a ground plane is provided which comprises an electrically conductive material and is electrically coupled to an electrical ground. A primary radiator element is provided which is disposed in a coplanar relationship to said ground plane and is electrically coupled to a signal path of a transceiver. Also provided is at least one switchable radiator element disposed in a coplanar relationship to the ground plane and the primary radiator element. At least one of the switchable radiator elements is selectively electrically coupled to one of the signal path of the transceiver and the electrical ground.

DETAILED DESCRIPTION

The present invention is directed generally towards switching radiator elements on a printed circuit board to focus beam power and radiation pattern coverage.

Figure 1:
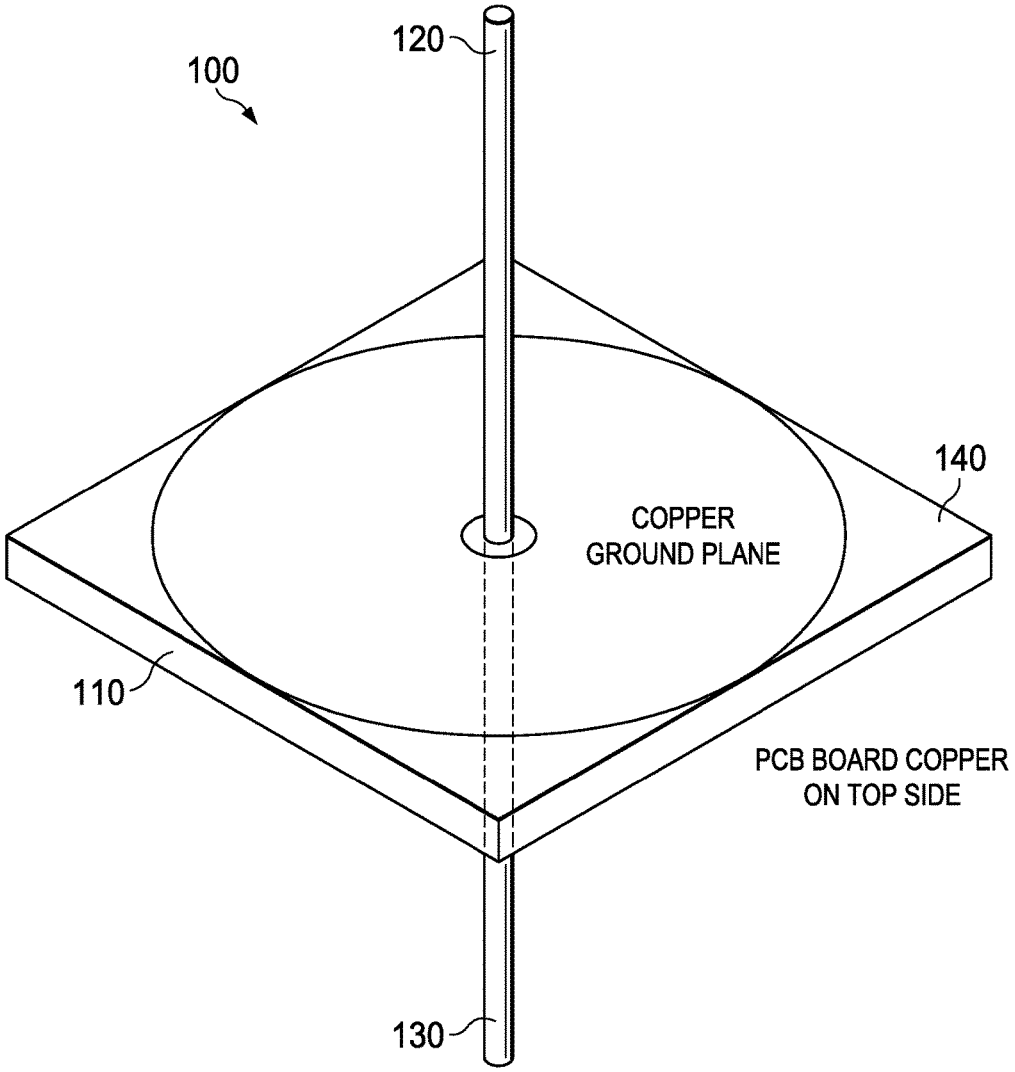
FIG. 1 (PRIOR ART)
FIG. 1 is a schematic diagram depicting a conventional three-dimensional antenna translated to the plane of a printed circuit board.
Figure 2:
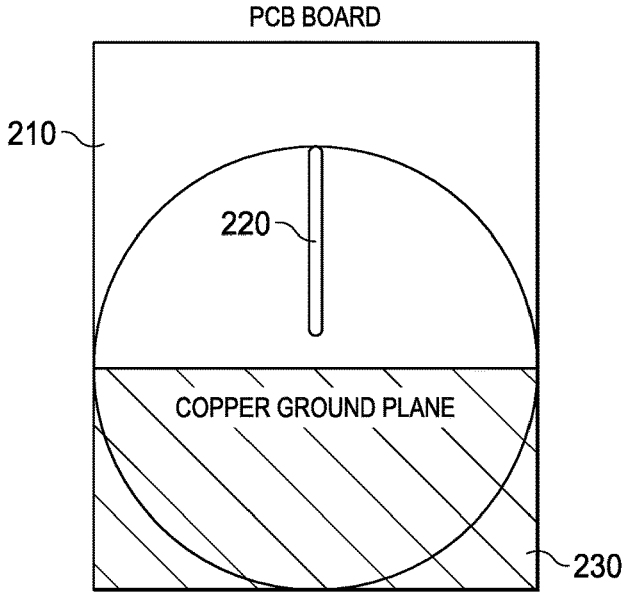
FIG. 2 (PRIOR ART)
FIG. 2 is a top view of a printed circuit board antenna.
Figure 3:
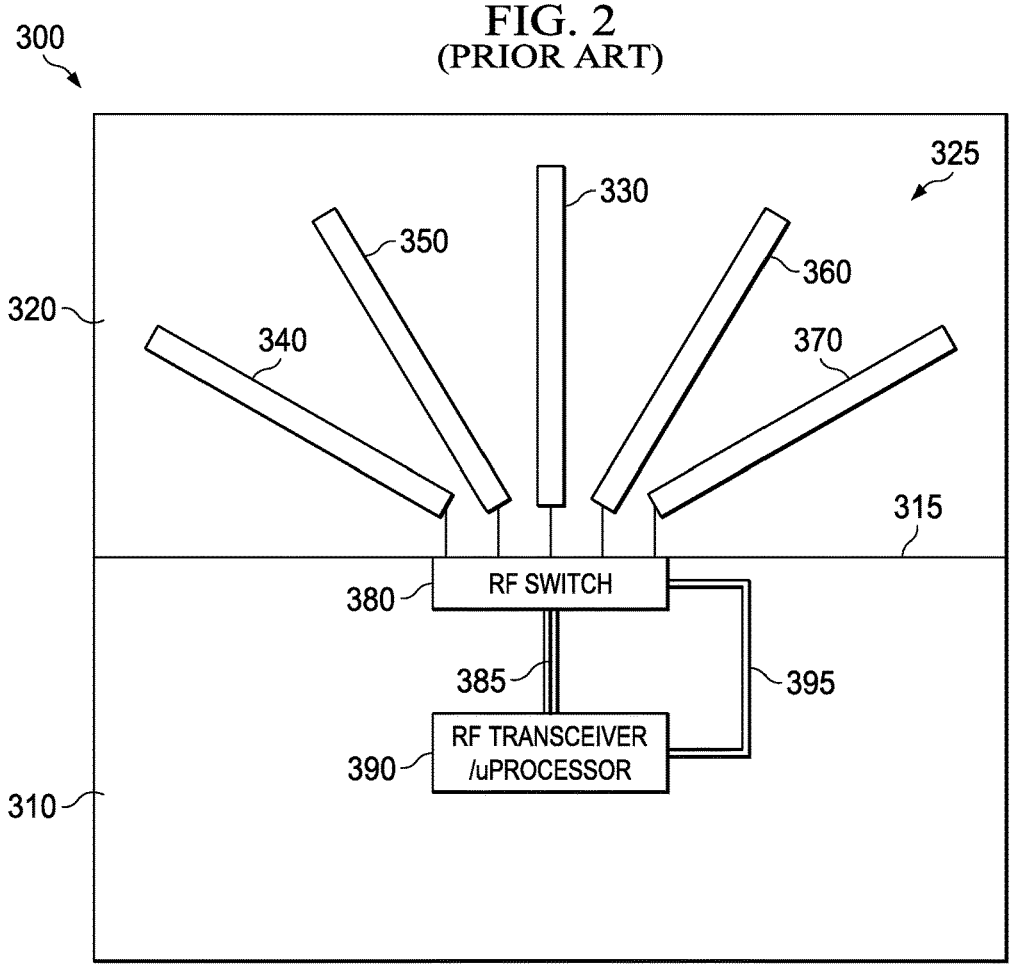
FIG. 3 is a top-view of a two-dimensional printed circuit board antenna in accordance with an illustrative embodiment of the invention.

FIG. 3 is a top-view of a two-dimensional printed circuit board antenna in accordance with an illustrative embodiment of the invention. In FIG. 3, the printed circuit board 300 includes a portion that comprises a ground plane 310. The ground plane 310 is an area or layer of electrically conductive material connected to the circuit's ground point, usually one terminal of the power supply. In some embodiments, the ground plane 310 comprises a layer of copper foil. In embodiments wherein the printed circuit board 300 is a multilayer PCB, the ground plane typically comprises a separate layer of the printed circuit board. The ground plane 310 serves as the return path for current from many different components on the printed circuit board 300. The ground plane further functions as part of an antenna structure 325, serving as part of the return dipole of the antenna 325. The antenna 325 further comprises a primary radiator element 330 and one or more switchable radiator elements, all disposed on a portion 320 of the printed circuit board 300 that does not include a copper ground layer. In the embodiment shown in FIG. 3, the antenna structure 325 includes four switchable radiator elements 340, 350, 360 and 370.

In one embodiment of the invention, the primary radiator element 330 is coupled to a radio frequency transceiver 390 in a fixed manner. In one embodiment, the RF transceiver 390 is part of a communications microprocessor and is a relatively low-power transceiver. The switchable radiator elements 340, 350, 360 and 370 are selectably couplable to either the RF transceiver 390 or to ground via the RF switch unit 380. The RF switch unit is coupled to the RF transceiver via RF signal path 385. In one embodiment, the RF switch unit 380 is implemented as a separate RF switch integrated circuit. In a further embodiment, the RF path 385 includes impedance matching networks in order to maximize the antenna power for higher efficiency. The configuration of the antenna 325 is adaptable via the selective coupling of the switchable radiator elements 340, 350, 360 and 370 to either the RF transceiver 390 or ground. The selection of which of the switchable radiator elements 340, 350, 360 and 370 are coupled to the RF transceiver 390 and which are coupled to ground alters the communication signal's coverage pattern and range. The antenna signal coverage can be varied from an omnidirectional antenna pattern to a pattern that focuses the antenna beam in a particular direction. The microprocessor 390 controls the configuration of the switches in the RF switch unit 380 via control bus 395.

In an illustrative embodiment of the invention, the primary radiator element 330 and the switchable radiator elements 340, 350, 360 and 370 are formed by depositing electrically conductive material, such as copper, on the surface of the printed circuit board 300. The primary radiator element 330 and the switchable radiator elements 340-370 are illustratively linear radiator elements. In an illustrative embodiment, the primary radiator element 330 extends perpendicularly to a straight edge 315 of the ground plane 310. In one illustrative embodiment, the primary radiator element 330 and the switchable radiator elements 340, 350, 360 and 370 all extend along a radius of a circle to a point on the circle itself. In one embodiment, the center of the circle corresponds to a point on the edge 315 of the ground plane 310. Thus the ends of the radiator elements 330-370 approach but do not come into contact with the edge of the ground plane 310. Illustratively, the switchable radiator elements 340-370 are disposed on both sides of the primary radiator element 330 at various angles to the primary radiator element, as depicted in FIG. 3. The selection of which of the switchable radiator elements are connected to the RF transceiver 390 and which to ground gives rise to different aperture spacings of radiator elements coupled to the transceiver 390. The aperture spacing, i.e., the angle between a radiator element and the ground plane 310, determines in part the directionality and power of the resulting signal. Increasing the aperture angle increases the power of the directional beam. Additionally, varying the number of switchable radiator elements that are connected to ground also gives rise to different coverage patterns.

Figure 4:
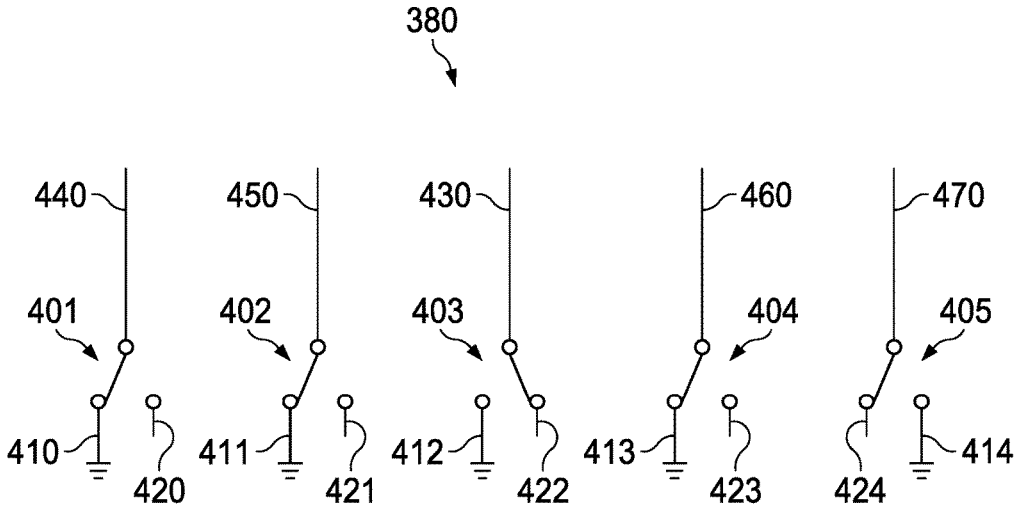
FIG. 4 is a schematic diagram representing the RF switch unit of FIG. 3 according to one embodiment of the invention.

In an alternative embodiment of the invention, all of the radiator elements 330-370, including element 330, are switchable radiator elements that can be selectably connected to either the RF transceiver 390 or to ground. FIG. 4 is a schematic diagram representing the RF switch unit 380 in this alternative embodiment. In an illustrative embodiment, the RF switch unit 380 is implemented as a separate integrated circuit. In the switch unit of FIG. 4, lead 430, lead 440, lead 450, lead 460, and lead 470 are coupled to radiator element 330, radiator element 340, radiator element 350, radiator element 360, and radiator element 370 of FIG. 3, respectively. Leads 440, 450, 430, 460, and 470 are connected to switches 401, 402, 403, 404 and 405, respectively. Terminals 410, 411, 412, 413 and 414 are coupled to ground. Terminals 420, 421, 422, 423, and 424 are coupled to the signal path of the RF transceiver 390. In an illustrative embodiment, the position of each of the switches 401-405, i.e., whether they are connected to ground or to the RF transceiver 390, is controlled by the microprocessor 390 via the control bus 395.

The determination by the microprocessor 390 of which radiator elements to select as active radiator elements and which to select as ground elements can be made in a number of ways. In some embodiments, the selection of radiator elements is made automatedly by the microprocessor 390. In these embodiments, the microprocessor stores and executes software algorithms that implement the selection of radiator elements. The selection of the radiator elements can be based on a variety of factors. In certain embodiments, the radiator selection is made to maximize signal power in a specified direction and/or to minimize the power usage required to achieve signal coverage in a specified direction and at a specified range. In a particular embodiment, the microprocessor 390 executes a software program that causes the RF switch 380 to cycle through various antenna configurations. At each antenna configuration, a measurement or measurements are taken to measure the signal strength of a signal received from one or more external devices. After these measurements are taken for a specified antenna configuration, the microprocessor 390 effects a new antenna configuration by instructing the RF switch 380 to modify which of the radiator elements 330-370 are coupled to the RF path 385 and which are coupled to ground. At each selected antenna configuration, the signal strength of the signal(s) received from the one or more external devices is measured. After all antenna configurations have been tested, the microprocessor selects an optimum configuration based on factors such as signal strength, directional coverage, and power usage. Other factors can also be used in making the determination. The microprocessor 390 then instructs the RF switch unit to implement the desired antenna configuration.

In other embodiments, the selection of the antenna configuration can be implemented manually by a user via a user interface of the microprocessor 390. In such embodiments, a calibration procedure can be performed manually by the user in order to determine an optimum selection of the radiator elements 330-370.

Figure 5:
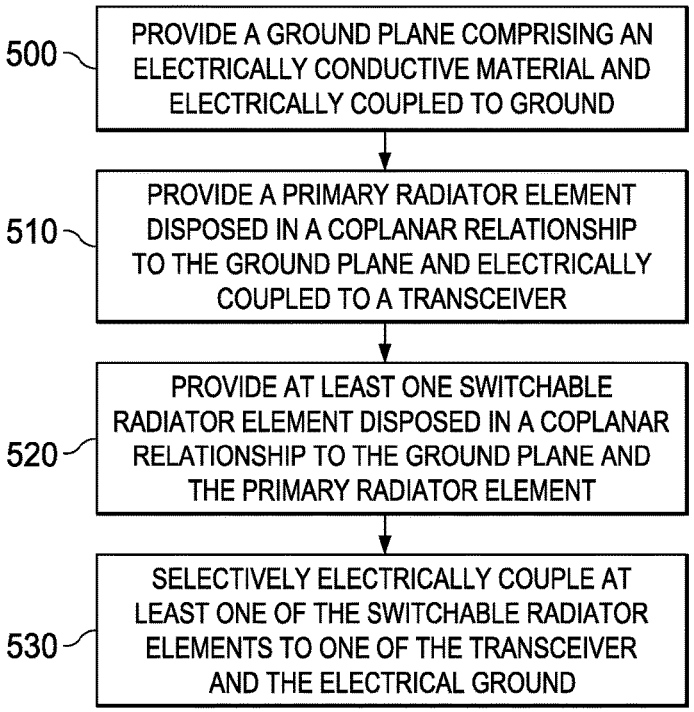
FIG. 5 is a flowchart representing a method of operating a two-dimensional antenna.

FIG. 5 is a flowchart representing a method of operating a two-dimensional antenna in accordance with an illustrative embodiment of the present invention. At block 500, a ground plane, such as ground plane 310 in FIG. 3, is provided. The ground plane comprises an electrically conductive material and is electrically coupled to an electrical ground. At block 510, a primary radiator element, such as radiator element 330, is provided. The primary radiator element is disposed in a coplanar relationship to said ground plane and is electrically coupled to a transceiver, such as transceiver 390. At block 520, at least one switchable radiator element, such as switchable radiator elements 340-370, is provided. The at least one switchable radiator element is disposed in a coplanar relationship to the ground plane and the primary radiator element. At block 530, at least one of the switchable radiator elements are is selectively electrically coupled to one of the transceiver and the electrical ground.

Having thus described circuits and methods for implementing a printed circuit board beam-forming antenna by reference to certain of its preferred embodiments, it is noted that the embodiments disclosed are illustrative rather than limiting in nature and that a wide range of variations, modifications, changes, and substitutions are contemplated in the foregoing disclosure. Furthermore, in some instances, some features of the present invention may be employed without a corresponding use of the other features. Accordingly, it is appropriate that the appended claims be construed broadly and in a manner consistent with the broad inventive concepts disclosed herein.

What is claimed is:

1. A two-dimensional antenna comprising:

a ground plane comprising an electrically conductive material and connected directly to an electrical ground;

a primary radiator element connected directly to a signal path of a transceiver, the primary radiator element being coplanar to the ground plane;

at least first and second switchable radiator elements coplanar to the ground plane, the first and second switchable radiator elements being on opposite sides of the primary radiator element and being angled relative to the primary radiator element, so that an end of the primary radiator element and respective ends of the first and second switchable radiator elements approach an edge of the ground plane;

a switch unit arranged to selectively connect the first switchable radiator element directly to the electrical ground or the signal path of the transceiver, and to selectively connect the second switchable radiator element directly to the electrical ground or the signal path of the transceiver, in response to a configuration selected by a microprocessor based on at least one of: signal strength, directional coverage or power usage.

2. The two-dimensional antenna of claim 1, wherein the primary radiator element and the first switchable radiator element are linear radiator elements forming an acute angle.

3. The two-dimensional antenna of claim 1, wherein the first and second switchable radiator elements are linear radiator elements forming acute angles with the primary radiator element.

4. The two-dimensional antenna of claim 1, wherein the ground plane comprises a straight edge and the primary radiator element is a linear radiator element disposed in a perpendicular relationship to the straight edge of the ground plane.

5. The two-dimensional antenna of claim 4, wherein the primary radiator element and the first switchable radiator element are linear radiator elements forming an acute angle.

6. The two-dimensional antenna of claim 4, wherein the first and second switchable radiator elements are linear radiator elements forming acute angles with the primary radiator element.

7. The two-dimensional antenna of claim 1, wherein the first and second switchable radiator elements are linear radiator elements forming symmetrical angles with the primary radiator element.

8. The two-dimensional antenna of claim 1, wherein the switch unit is arranged to selectively connect the first switchable radiator element directly to the electrical ground or the signal path of the transceiver, and to selectively connect the second switchable radiator element directly to the electrical ground or the signal path of the transceiver, to adjust a directional coverage pattern of a communication beam of the two-dimensional antenna.

* * * * *